US009909362B2

(12) United States Patent
Schneider

(10) Patent No.: US 9,909,362 B2
(45) Date of Patent: Mar. 6, 2018

(54) SLAT HOLDER

(71) Applicant: Okalux GMBH, Marktheidenfeld (DE)

(72) Inventor: Frank Schneider, Marktheidenfeld (DE)

(73) Assignee: Okalux GMBH, Marktheidenfeld (DE)

( * ) Notice: Subject to any disclaimer, the term of this patent is extended or adjusted under 35 U.S.C. 154(b) by 0 days.

(21) Appl. No.: 15/107,403

(22) PCT Filed: Dec. 23, 2014

(86) PCT No.: PCT/EP2014/079288
§ 371 (c)(1),
(2) Date: Jan. 23, 2017

(87) PCT Pub. No.: WO2015/097275
PCT Pub. Date: Jul. 2, 2015

(65) Prior Publication Data

US 2017/0089131 A1 Mar. 30, 2017

(30) Foreign Application Priority Data

Dec. 23, 2013 (DE) ..... 10 2013 114 817

(51) Int. Cl.
*E06B 7/08* (2006.01)
*E06B 9/38* (2006.01)
*E06B 9/264* (2006.01)

(52) U.S. Cl.
CPC ..... *E06B 9/38* (2013.01); *E06B 9/264* (2013.01); *E06B 2009/2643* (2013.01)

(58) Field of Classification Search
CPC ..... E06B 9/38; E06B 9/264; E06B 2009/2643
(Continued)

(56) References Cited

U.S. PATENT DOCUMENTS 207,026 A * 8/1878 Fuller ..... B61D 27/0081 292/345
390,392 A * 10/1888 Niss ..... E06B 9/307 160/163

(Continued)

FOREIGN PATENT DOCUMENTS

| | | |
|---|---|---|
| DE | 3432113 A1 | 3/1986 |
| DE | 4001471 A1 | 7/1990 |
| EP | 0558154 A2 | 9/1993 |

OTHER PUBLICATIONS

International Search Report dated Mar. 27, 2015, in International Patent Application No. PCT/EP2014/079288, filed on Dec. 23, 2014.

(Continued)

*Primary Examiner* — Jerry E Redman
(74) *Attorney, Agent, or Firm* — Downs Rachlin Martin PLLC

(57) ABSTRACT

The invention relates to a holder for one or more elongate elements (70, 72), particularly slats for shading systems and daylight control systems, comprising an elastic or resilient compensating unit having two profiles (50, 150) which are located opposite one another and engage in one another and are arranged such as to be movable relative to one another in the longitudinal direction of the elongate elements (70, 72), said two profiles forming a common interior (90). Accommodated in the interior (90) is a spring element (92) which is compressed when the elongate element (70, 72) expands under the effect of temperature and which relaxes when the elongate element (70, 72) contracts in the longitudinal direction of the elongate element (70, 72). The spring element is held in the interior (90) with a clamping fit or friction fit, a compensating movement in the longitudinal direction being possible. The profiles of the compensating unit each comprise, on the side facing away from the interior (Continued)

(90), a further profile (30, 130) which is formed in one piece therewith and is designed to hold the elongate elements (70, 72) or as a spacer from a window frame or carrier element (8). The components, consisting in each case of one profile (50, 150) of the compensating unit and a further profile (30, 130), are identical.

12 Claims, 3 Drawing Sheets

(58) Field of Classification Search
USPC ..... 49/92.1, 403
See application file for complete search history.

(56) References Cited

U.S. PATENT DOCUMENTS

| | | | | |
|---|---|---|---|---|
| 702,148 | A * | 6/1902 | Nettleton | E06B 7/084 49/403 |
| 2,146,142 | A * | 2/1939 | Heasley | F23L 13/00 126/285 R |
| 5,339,591 | A * | 8/1994 | Underdahl | E06B 7/082 49/74.1 |
| 5,887,386 | A * | 3/1999 | Alexanian | E06B 7/086 49/403 |
| 6,595,379 | B1 * | 7/2003 | Powell | A47B 57/50 211/192 |
| 6,655,091 | B1 * | 12/2003 | Iwasaki | E06B 7/09 49/403 |
| 6,722,082 | B1 * | 4/2004 | Peterson | E06B 7/22 49/428 |
| 8,474,187 | B2 * | 7/2013 | Marocco | E06B 7/086 49/403 |
| 8,893,434 | B1 * | 11/2014 | Konstantin | E06B 7/096 160/236 |
| 2002/0050326 | A1 * | 5/2002 | Kawakita | E06B 9/30 160/168.1 R |
| 2002/0053410 | A1 * | 5/2002 | Mayr | E06B 3/6722 160/98 |
| 2003/0173036 | A1 | 9/2003 | Kwon et al. | |
| 2011/0061821 | A1 * | 3/2011 | Kim | E06B 9/264 160/305 |
| 2014/0216666 | A1 * | 8/2014 | Smith | E06B 9/38 160/84.04 |
| 2014/0224437 | A1 * | 8/2014 | Colson | E06B 9/42 160/291 |
| 2017/0009524 | A1 * | 1/2017 | Dwarka | E06B 9/24 |
| 2017/0018161 | A1 * | 1/2017 | Alpert | E06B 9/326 |
| 2017/0089131 | A1 * | 3/2017 | Schneider | E06B 9/38 |

OTHER PUBLICATIONS

International Preliminary Report on Patentability dated Jun. 28, 2016, in connection with International Patent Application No. PCT/EP2014/079288, filed on Dec. 23, 2014.

* cited by examiner

SLAT HOLDER

FIELD OF THE INVENTION

The invention relates to a holder for slats, in particular slats for shading systems and daylight control systems. The slats of such systems are arranged in many of these systems between two window panes or in front of or behind the window pane.

BACKGROUND

The slats can be attached to the window frame, to a carrier element or to the insulating glass spacer in various ways. They can extend at an angle or e.g. be located in a C-profile attached to the window frame or carrier element, can be suspended on a profile (DE 34 32 113 A1) or can be connected to a carrier element e.g. by adhesion or welding (DE 40 01 471 A1). It is also typical to mount the slats, arranged in the pane intermediate space, so as to be movable, in that they are held in elongate holes so that the slats can expand or contract as the temperature changes. A disadvantage of this type of holder is that the slats, owing to the clearance in the holder allowing the movement of the slats, tend to assume an undefined position in said holder. As a result, the slats can rattle.

EP 0 558 154 A2 relates to window blinds actuated by a pull cord. FIG. 45(B) illustrates a sealing element 170 which is arranged in a frame structure 5 and has engagement pieces 172 and is pressurized by a spring 173 on the outer side. On the inner side, the sealing element 170 engages with a side edge of the pleat fabric 1 by means of a sliding element 174. A gap between the side edge of the pleat fabric 1 and the inner side of the opening/closing zone is closed by means of the described arrangement of the sealing element 170.

The object of the invention is to provide a holder for slats of shading systems and daylight control systems, which holder is adapted to the changes in length of the slats under the effect of temperature and ensures a defined position for the slats.

This object is achieved by a holder having the features of claim 1. Advantageous developments of the holder in accordance with the invention are described in the dependent claims.

A holder in accordance with the invention for one or more elongate elements, in particular slats for shading systems and daylight control systems, thus includes an elastic or resilient compensating unit having two profiles which are located opposite one another and engage in one another and are arranged so as to be movable relative to one another in the longitudinal direction of the elongate elements, said two profiles forming a common interior in which a spring element is accommodated. The spring element is compressed when the elongate element expands under the effect of temperature and relaxes when the elongate element contracts in the longitudinal direction of the elongate element. The spring element is held in the interior with a clamping fit or friction fit. At the same time, the spring element has a degree of freedom of movement because, owing to the movability of the profiles, a compensating movement of the spring element in the longitudinal direction is made possible. The common interior of the compensating unit is delimited by web parts which extend transversely with respect to the longitudinal direction of the elongate elements and in each case by a limb, extending in the longitudinal direction, of the movably arranged profiles of the compensating unit. The web parts are provided as a stop for the limbs. The compensating unit comprises, on the side opposite the interior and facing the elongate elements, a further profile for accommodating the elongate elements and, on the side opposite the first profile, a still further profile as a spacer from a window frame or carrier element or for accommodating one or more further elongate elements. The further profiles are each formed in one piece with the corresponding movably arranged profiles of the compensating unit, wherein they each comprise a common web part therewith. In each case, the outer side of a limb of the profiles of the compensating unit is substantially aligned with the outer side of a limb, which is located on the same web side as seen in the transverse direction with respect to the elongate elements, of the relevant further profile. Each other limb of the profiles of the compensating unit is not aligned with the limb located on the same web side but is arranged offset with respect to the longitudinal axis thereof in the profile interior and is surrounded on the outside in each case by the other limb of the relevant further profile. The components, each consisting of one profile of the compensating unit and one further profile having a common transverse web, are identical.

By providing the elastic or resilient compensating unit in the holder, an elastic, floating bearing for the elongate element(s) is provided. The holder is suitable for slats or slat hangings in the pane intermediate space of insulating glasses which are used for shading or daylight control. It is then supported, as seen in the horizontal direction, on the pane spacer which holds the two insulating glass panes in position. As seen in the vertical direction, it is typically located with the lower end on the pane spacer. The slats are always fixed in position. If the holder is inserted as a connection piece between two slat hangings, a secure arrangement can also be achieved by two and more slat hangings in the required length. Owing to the effect of the compensating element, an automatic, uniform length compensation occurs.

In addition to the spring and compensation property with respect to changes in the slat length, the spring element has a connecting function owing to its friction fit or press fit, as will be explained further hereinafter. Owing to its clamping fit or friction fit and the provided biasing, the spring element fixes the limbs, which are laterally adjacent thereto, of the two movable profiles of the compensating unit (compensating profiles) which laterally delimit the interior. In this manner, the compensating profiles forming the interior are prevented from moving away from each other.

In an advantageous manner, the further profiles are at least partially integrated with the compensating unit. Owing to the common web part, one profile of the compensating unit and one further profile thus form a single-piece component in each case. In the case of U-profiles, the integrated profiles are then H-profiles. The spring element is then located between these two components.

The design having offset profile limbs, which terminate in a flush manner, of the compensating unit results in the holder having a flat external shape. If a flexible main body is located as a spring element for example in the interior of the compensating element, then this exerts a pressure in the longitudinal direction of the elongate element, such as e.g. the slat(s), against the web of the first profile, said pressure acting on the elongate element. At the same time, it also exerts a pressure in the transverse direction, i.e. in the direction of the outer and inner pane. As a result, the inner limbs, in contact with the spring element, of the two profiles of the compensating unit are connected together by the spring element. In this manner, relative movement of the two holding parts out of the pane plane is reliably prevented.

Since the components or holder parts, each consisting of one profile of the compensating unit and a further profile, are identical, it is only necessary to produce and store one component. The components are paired to form the holder in that one of said components is pivoted about an axis in parallel with the profile limbs and about an axis transverse thereto.

The holder preferably consists of metal, e.g. aluminum, stainless steel. It is possible to use other materials such as e.g. synthetic material or fiber composite materials which have the required properties in relation to strength, expansion properties. In order to prevent the holder from scraping against the adjacent window pane, it is preferable to provide spacers between the movable part of the holder and the window pane. Owing to the movement of the compensating unit under the effect of temperature, this spacer is located in the slide bearing arrangement on the window pane and lies securely against the outer side of the moving part of the holder. In an expedient manner, the spacers are produced from synthetic material, e.g. block profiles or pins. Owing to the slide bearing arrangement, the movable part of the holder can move back and forth together with the slat end(s) in the longitudinal direction of the slat under the effect of the compensating unit.

The spring element of the compensating unit can be a spring, e.g. a leaf spring. This can be biased. In an advantageous manner, a flexible main body having the required elastic properties (spring property) can be used and is inserted into the interior of the compensating unit. An elastomer is used, for example, as the material. However, other synthetic materials or materials having elastic properties can also be used.

The holder in accordance with the invention is suitable for holding just one elongate element but also a number of elongate elements. It is suitable for use in shading slats, in particular inner slats. However, the invention is not limited to holding slats.

SUMMARY OF THE DISCLOSURE

In one exemplified embodiment of the invention, at least one of the further or still further profiles is a U-profile. Also, at least one of the movably arranged profiles can be a U-profile. Other profile shapes are possible. These result from the respective application, mounting conditions, screening arrangement and aesthetic aspects, etc.

The holder in accordance with the invention can be designed such that the profiles are provided on the outer sides with a surface design, in particular fluting, or a similar structuring for visual or aesthetic reasons.

In another example of the invention, the aligned outer sides of the limbs are each provided at the ends with a bracket or outer flange. Then, the above-mentioned spacer, e.g. a block profile, is located between the two brackets or flanges and is securely positioned in this manner.

In one embodiment of the invention, the brackets or outer flanges of the limbs, comprising the aligned outer sides, of one profile of the compensating unit and of the further profile are substantially aligned with the outer side of the still further profile on the same holder side. In this manner, the outer surface of the mounted holder is continuous and thus has an appealing visual appearance.

In one embodiment of the holder in accordance with the invention, the sliding surface is recessed in the visible region of the compensating unit. This can be provided, for example, by forming a recess in the respective mating profile so that the two profiles do not slide one against the other in the region of the recess and at that location there is no material stress with resulting traces of abrasion.

The elongate element is preferably attached to the holder, e.g. is adhered into the accommodating profile. In this manner, it is ensured that the movement caused by the temperature or expansion-contraction occurs in the longitudinal direction in the compensating unit.

BRIEF DESCRIPTION OF THE DRAWINGS

The invention will be further described hereinafter with the aid of exemplified embodiments and the drawing. This depiction is merely for illustrative purposes and is not intended to limit the invention to the feature combinations specifically stated. In the drawing.

DETAILED DESCRIPTION

Figure 1:
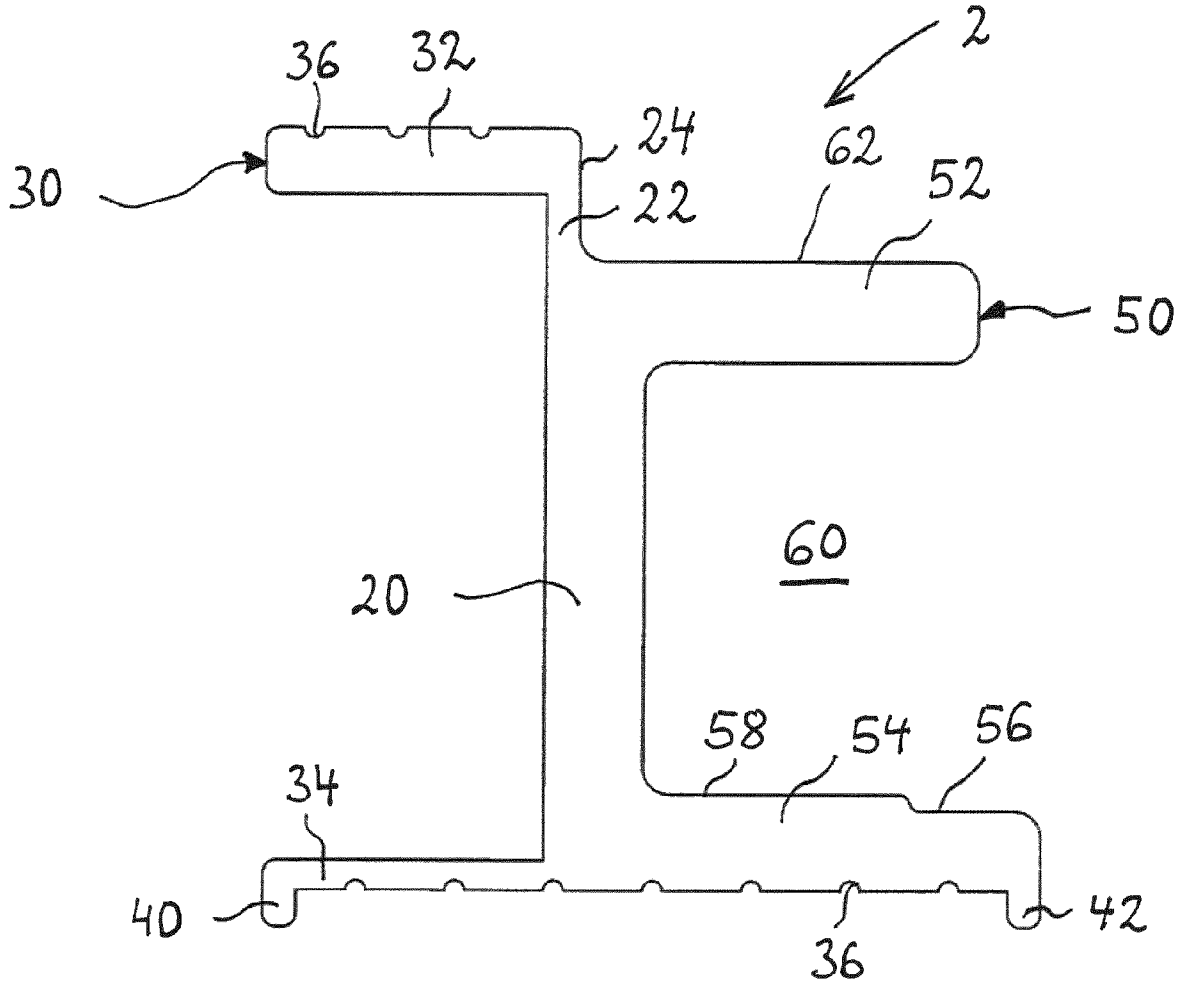
FIG. 1 shows a plan view of a holding part in accordance with the invention.

The holder in accordance with the invention will be explained hereinafter firstly with the aid of FIG. 1 and one exemplified embodiment which is provided for holding slats for shading systems and daylight control systems. The design is one with two identical components which are placed one inside the other after corresponding pivoting and are each referred to hereinafter as a holding part. The orientation of the illustrated holding part 2 is such that in FIG. 1 the slat is located on the left of the holding part 2 and the second holding part is located on the right of holding part 2.

The holding part 2 includes a first web part 20 which is common for two profiles 30, 50 pointing in opposite directions. The profiles 30, 50 can have a different width and wall thickness, like in the illustrated exemplified embodiment. In the illustrated exemplified embodiment, the two profiles 30, 50 are U-profiles. They are integrated and thus together form an H-profile. The first profile 30 (accommodating profile) which faces the slats, is provided for accommodating the slats and has a smaller wall thickness is wider and accordingly the first web part 20 continues with a second web part 22 of thinner wall thickness. The two web parts 20, 22 together form the web of the first profile 30. The limbs 32, 34 of the profile 30 have different thicknesses. The limbs of the profile 30 can also have different thickness ratios or can have the same thickness. The thickness thereof is smaller than the thickness of the first web part 20. The thicker limb 32 extends from the outer end of the second web part 22 and the thinner limb 34 extends from the outer end of the web part 20, in each case in the slat direction. The limbs 32 and 34 are provided on the outside with a fluting 36. The limb 34 comprises, on the free end, an outer flange 40 provided as a stop.

The second profile 50 which points in the opposite direction to the first profile 30 and forms a part of a compensating unit which is explained in more detail hereinafter has limbs 52 and 54, the thickness of which corresponds approximately to the thickness of the first web part 20 which represents the web of the second profile 50. The thickness of the limbs can also be different. The outer side of the limb 54 which points in the opposite direction to the thinner limb 34 is aligned with the outer side of the limb 34 and is likewise provided with the fluting 36. At the free end, the limb 54 is provided with an outer flange 42 used as a stop. On the inner side, the limb 54 is provided in the outer region with a recess 56 whilst the remaining region 58 is a sliding surface. The other limb 52 of the second profile 50 extends at the other end of the first web part 20 away therefrom. It is thus offset inwardly in relation to the thicker limb 36 of the first profile. The outer surface 62 of the limb 22 is likewise a sliding surface. The two limbs 52, 54 of the second profile 50 surround a space 60. On the outside, the second web part 22 protrudes from the second profile or the limb 52 thereof and forms a stop surface 24.

Figure 2:
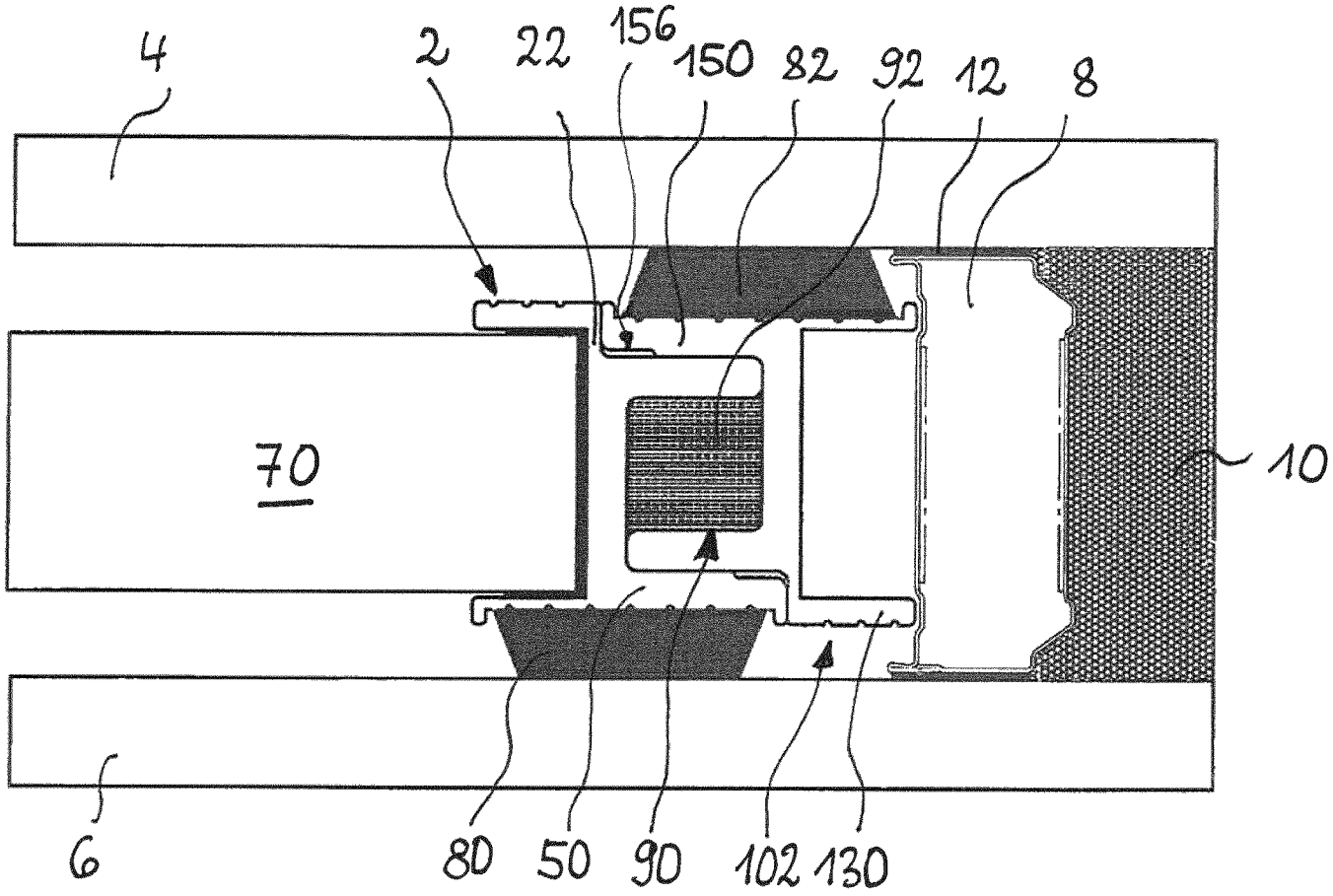
FIG. 2 shows a plan view of the end section of a double-pane insulating glass in which a slat holder in accordance with the invention is shown in the mounted state.
Figure 3:
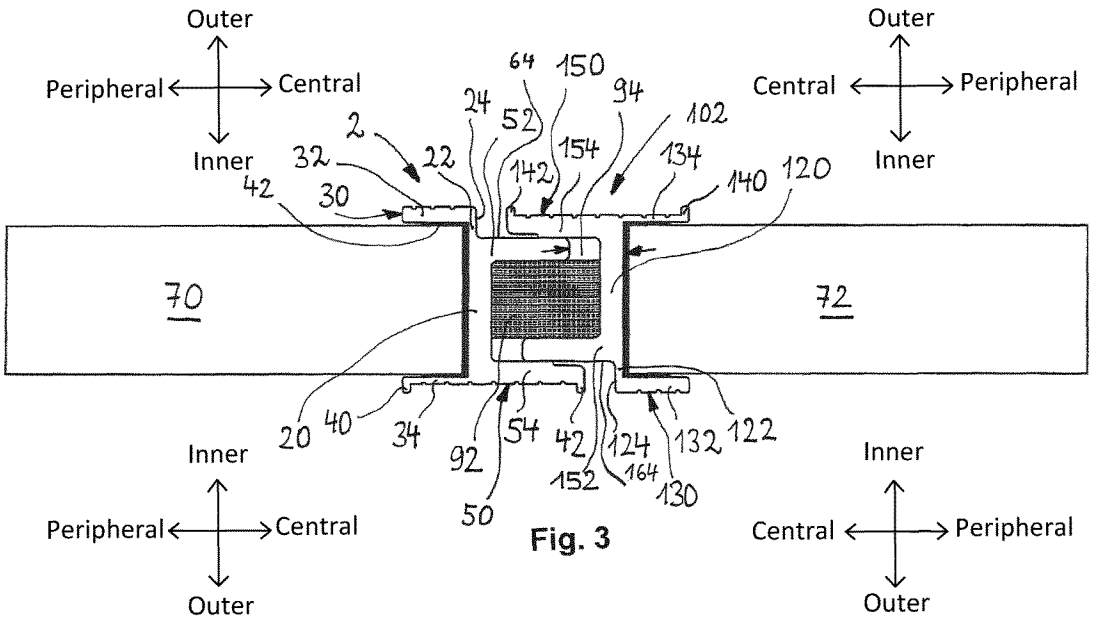
FIG. 3 shows a plan view of a holder in accordance with the invention which is used as a connection element for, and the attachment of, two slat hangings.

FIG. 2 illustrates the mounted state and mode of operation of a holder, consisting of two holder parts 2, 102, in the pane intermediate space of a multi-pane insulating glass and FIG. 3 illustrates the arrangement in the case of a connection element for two slat hangings. FIGS. 2 and 3 illustrate the holder in different situations: in FIG. 2 with a completely compressed compensating unit and in FIG. 3 with a more relieved compensating unit. The reference numerals are the same in the two figures. The holder parts 2, 102 are identical to the holder part 2 in FIG. 1 and therefore are not described in detail again.

FIG. 2 illustrates two glass panes 4, 6. A spacer 8 holds the glass panes 4, 6 at a distance apart from each other. A seal 10 e.g. consisting of polysulfide or polyurethane is used to seal the interior. The spacer 8 is connected to the glass panes 4, 6 by means of an adhesive layer 12 consisting of e.g. butyl rubber and also having a sealing function. The holder part 102 is supported with respect to the spacer 8, wherein the holder part 102 is arranged rotated about two axes (longitudinal axis and transverse axis—with respect to the slat) compared with the illustration of the holder part 2 in FIG. 1, i.e. the wider profile 130 having the thinner walls points towards the spacer and the profile 150 having the thicker walls points into the window interior, thus in the direction of the slat and the profile limbs have swapped position with respect to the panes (inner/outer). The other holder part 2 provided for accommodating slats is shown in the same arrangement as in FIG. 1. As shown, one end of a slat 70 is accommodated by the profile 30. In order to fix the slat 70 in the profile 30, an adhesive layer 44 has been applied. Instead of adhesive, other fastening means can also be chosen, e.g. welding.

As shown, the two holder parts 2, 102 are slid one inside the other. The limbs 52, 152 each terminate at the web of the opposite profile 150, 50 and surround, together with these bases, an interior 90 which is slightly smaller than the space 60 illustrated in FIG. 1 owing to the reduced width. The two other limbs 54, 154 each adjoin, on the outside, the limbs 52, 152 of each opposite profile 150, 50 in sliding engagement. In the position illustrated in FIG. 2, they abut against the stop surfaces 124, 24 with their end sides. Pins 80, 82 consisting of synthetic material are arranged between the outer sides of the limbs 54, 154 and the panes 4, 6 as spacers, wherein this is a slide bearing arrangement with respect to the panes. Instead of pins, e.g. block profiles can also be used. A spring element 92 is located in the interior 90. In the illustrated exemplified embodiment, this is a flexible main body consisting of synthetic material which is elastic and has spring properties. The main body 92 has larger dimensions than the interior 90 and is press-fitted therein. Owing to the resulting biasing, the main body prevents the two profiles 50, 150 of the compensating unit from being moved apart from each other. Longitudinal movement is possible because in this case a degree of freedom of movement is provided for the main body 92.

FIG. 3 shows the holder, consisting of the two holder parts 2, 102, in its function as a connection element for two slat hangings. However, as shown in FIG. 2, the holder parts 2, 102 are not located in the completely slid-together position but are somewhat slid apart from each other, see reference numeral 94. The two profiles 30, 130 are used in this embodiment to accommodate slats 70, 72. If further slat hangings are to be combined, further connection elements have to be provided accordingly.

The views in FIGS. 2 and 3 show the function of the recess 56 and 156 of the limb 54 and 154 respectively. The material recess ensures that when the outer surface of the limb 154 slides along the inner surface of the limb 54, the region 64 of the outer surface of the limb 54 which is visible from the outside remains free of material contact. Accordingly, the visible part 164 of the outer surface of the limb 152 is likewise not a sliding surface owing to the recess 156. In this manner, no visible traces of abrasion are produced on the profile outer surface in these regions.

The function of the holder compensating for the effect of temperature fluctuations, i.e. of the compensating unit thereof having the profiles 50, 150 and the spring element 92, will be explained in more detail hereainafter. The dimensions of the interior 90 and the properties and dimensions of the spring element 92 (elasticity, expansion coefficient, etc.) are adapted to the material properties of the slats 70, 72 and also of the glass panes 4, 6. If the slats and the glass panes expand when the temperature increases, the spring element 92 is compressed until it reaches the stop of the U-limbs 52, 54 and 152, 154. This situation is shown in FIG. 2. However, the end position for the maximum slat expansion does not necessarily have to be the illustrated stop position but can also be located in front of this position in the direction of movement. The dimensions of the U-profiles 50, 150 must, for example, also be such that one of the limb pairs is located in abutment at this end position of maximum slat expansion and the other is not. In contrast, if the outside temperature cools, the slats contract somewhat and the spring element expands owing to its biasing and presses the profiles 50, 150 apart from each other. The slats can thus always be pressurized to the necessary extent in order to be fixed in position. Such a situation is shown in FIG. 2. The movement stroke compared with the situation in FIG. 3 is shown by the reference numeral 94. When the profile 50 moves, the spacer 80 has moved with it which is permitted by the slide bearing arrangement in relation to the window pane 6.

The invention claimed is:

1. A holder for one or more elongate elements for shading systems and daylight control systems, comprising:

a resilient compensating unit having two movably arranged profiles which are located opposite one another, engage in one another, and are arranged so as to be movable relative to one another in a longitudinal direction of the one or more elongate elements, said two movably arranged profiles forming a common interior in which a spring element is accommodated, wherein the spring element is compressed when the one or more elongate elements expand as a result of a temperature change and relaxes when the one or more elongate elements contract in the longitudinal direction of the one or more elongate elements, wherein:

the spring element is held in the common interior with a clamping fit or friction fit such that a compensating movement in the longitudinal direction of the one or more elongate elements is possible;

the common interior of the resilient compensating unit is delimited by web parts that extend transversely with respect to the longitudinal direction of the one or more elongate elements and by inner central limbs of the movably arranged profiles of the resilient compensating unit, wherein the inner central limbs extend in the longitudinal direction of the one or more elongate elements and the web parts are provided as a stop for the inner central limbs;

the resilient compensating unit comprises, on a side opposite the common interior and facing a first elongate element, a further profile for accommodating the first elongate element and, on a side of the resilient compensating unit opposite the further profile, a still further profile as a spacer from a window frame or carrier element or for accommodating one or more further elongate elements;

the further profiles are each respectively formed in one piece with a corresponding movably arranged profile of the resilient compensating unit, wherein each of the further profiles and the corresponding movably arranged profile share a common web part;

outer sides of two outer central limbs of the movably arranged profiles of the resilient compensating unit are each respectively substantially aligned with a corresponding outer side of a respective peripheral limb located on a same side as a corresponding one of the further profiles relative to a corresponding respective web part, wherein the inner central limbs of the movably arranged profiles of the resilient compensating unit are not aligned with the peripheral limbs but are arranged offset with respect to a longitudinal axis thereof, located in an opposing movably arranged profile interior, and are surrounded by a corresponding outer central limb of an opposing movably arranged profile; and each set of a respective movably arranged profile of the resilient compensating unit and a corresponding respective one of the further profiles sharing a common transverse web part therewith is identical to an opposing set of a respective movably arranged profile and a corresponding respective one of the further profiles sharing a common transverse web part therewith.

2. A holder as claimed in claim 1, wherein the spring element is a leaf spring.

3. A holder as claimed in claim 1, wherein the spring element is a flexible main body having spring properties.

4. A holder as claimed in claim 3, wherein the spring element is an elastomer.

5. A holder as claimed in claim 1, wherein at least one of the further profiles is a U-profile.

6. A holder as claimed in claim 1, wherein at least one of the movably arranged profiles is a U-profile.

7. A holder as claimed in claim 1, wherein corresponding, attached ones of the outer central limbs and the peripheral limbs have aligned outer sides each include a bracket or outer flange on one end.

8. A holder as claimed in claim 7, wherein the brackets or outer flanges of the outer central limbs and the peripheral limbs, comprising the aligned outer sides, of one of the movably arranged profiles of the resilient compensating unit and of the further profile are substantially aligned with an outer side of the still further profile on the same side of the holder.

9. A holder as claimed in claim 1, wherein the movably arranged profiles and further profiles are provided on outer sides with a surface design including fluting.

10. A holder as claimed in claim 1, wherein a sliding surface is recessed within the resilient compensating unit.

11. A holder as claimed in claim 1, wherein the one or more elongate elements are adhered into one or more of the further profiles.

12. A holder as claimed in claim 1, wherein said elongate elements comprise slats.

* * * * *